US005842316A

United States Patent [19]

Keiper

[11] Patent Number: 5,842,316

[45] Date of Patent: Dec. 1, 1998

[54] ROOF PANEL MOUNTING SYSTEM

[76] Inventor: Timothy John Keiper, 3114 Division, Scranton, Pa. 18504

[21] Appl. No.: 19,358

[22] Filed: Feb. 5, 1998

[51] Int. Cl.[6] ..... E04B 7/00

[52] U.S. Cl. ..... 52/410; 52/409; 52/506.05; 52/309.11; 52/478; 52/543

[58] Field of Search ..... 52/408, 409, 410, 52/552, 506.05, 537, 546, 747.1, 748.1, 309.11, 520, 547, 535, 536, 478, 543

[56] References Cited

U.S. PATENT DOCUMENTS

| | | | |
|---|---|---|---|
| 1,386,130 | 8/1921 | Marks et al. | 52/537 X |
| 2,057,654 | 10/1936 | Voigt | 52/409 |
| 2,293,743 | 8/1942 | Miles et al. | 52/409 X |
| 2,857,995 | 10/1958 | Boulton | 52/520 |
| 3,031,044 | 4/1962 | Stitt et al. | 52/506.05 X |
| 3,209,503 | 10/1965 | Mostoller | 52/478 |
| 3,852,933 | 12/1974 | Guzzo | 52/533 |
| 4,133,161 | 1/1979 | Lester | 52/748.1 |
| 4,348,846 | 9/1982 | Bellem | 52/410 |
| 4,429,503 | 2/1984 | Holliday | 52/410 |
| 4,570,404 | 2/1986 | Knudson | 52/478 X |
| 4,590,728 | 5/1986 | Stroberg | 52/410 |
| 4,602,468 | 7/1986 | Simpson | 52/410 |
| 4,651,489 | 3/1987 | Hodges et al. | 52/409 |
| 5,072,563 | 12/1991 | Menegoli | 52/537 |
| 5,181,360 | 1/1993 | Shingler | 52/547 X |
| 5,187,911 | 2/1993 | Cotter | 52/537 |
| 5,230,192 | 7/1993 | Webb et al. | 52/408 X |

*Primary Examiner*—Robert Canfield

[57] ABSTRACT

A new roof panel mounting system for securing to an underlying roof support structure to preclude leaking. The inventive device includes a sheet of plywood secured to a support structure of a house. A sheet of insulation material is positionable on the sheet of plywood. A sheet of paneling is positionable on the sheet of insulation material. The sheet of paneling has a plurality of ridges extending upwardly therefrom. The sheet of paneling is coupled with respect to the sheet of plywood and the sheet of insulation material.

10 Claims, 5 Drawing Sheets

ROOF PANEL MOUNTING SYSTEM

BACKGROUND OF THE INVENTION

1. Field of the Invention

The present invention relates to roofing panels and more particularly pertains to a new roof panel mounting system for securing to an underlying roof support structure to preclude leaking.

2. Description of the Prior Art

The use of roofing panels is known in the prior art. More specifically, roofing panels heretofore devised and utilized are known to consist basically of familiar, expected and obvious structural configurations, notwithstanding the myriad of designs encompassed by the crowded prior art which have been developed for the fulfillment of countless objectives and requirements.

Known prior art roofing panels include U.S. Pat. No. 4,133,161 to Lester; U.S. Pat. No. 5,072,563 to Menegoli; U.S. Pat. No. 4,423,581 to Miller; U.S. Pat. No. 3,990,206 to Reusser; U.S. Pat. No. 5,058,333 to Schwartz; and U.S. Pat. No. 4,982,542 to Funaki.

While these devices fulfill their respective, particular objectives and requirements, the aforementioned patents do not disclose a new roof panel mounting system. The inventive device includes a sheet of plywood secured to a support structure of a house. A sheet of insulation material is positionable on the sheet of plywood. A sheet of paneling is positionable on the sheet of insulation material. The sheet of paneling has a plurality of ridges extending upwardly therefrom. The sheet of paneling is coupled with respect to the sheet of plywood and the sheet of insulation material.

In these respects, the roof panel mounting system according to the present invention substantially departs from the conventional concepts and designs of the prior art, and in so doing provides an apparatus primarily developed for the purpose of securing to an underlying roof support structure to preclude leaking.

SUMMARY OF THE INVENTION

In view of the foregoing disadvantages inherent in the known types of roofing panels now present in the prior art, the present invention provides a new roof panel mounting system construction wherein the same can be utilized for securing to an underlying roof support structure to preclude leaking.

The general purpose of the present invention, which will be described subsequently in greater detail, is to provide a new roof panel mounting system apparatus and method which has many of the advantages of the roofing panels mentioned heretofore and many novel features that result in a new roof panel mounting system which is not anticipated, rendered obvious, suggested, or even implied by any of the prior art roofing panels, either alone or in any combination thereof.

To attain this, the present invention generally comprises a sheet of plywood secured to a support structure of a house. A sheet of insulation material is positionable on the sheet of plywood. The sheet of insulation material has a thickness greater than a thickness of the plywood. A sheet of paneling is positionable on the sheet of insulation material. The sheet of paneling has a plurality of ridges extending upwardly therefrom. Each of the ridges has a generally frustoconical configuration. The sheet of paneling has planar portions intermittently disposed between the plurality of ridges. Each of the planar portions have an upper surface and a lower surface. Each lower surface has a chamber extending downwardly therefrom. Coupling means couple the chambers of the sheet of paneling with respect to the sheet of plywood and the sheet of insulation material. The coupling means includes bolts having an enlarged upper ends positioned within the chambers. The bolts have shafts extending outwardly of the chambers and extend through the sheet of insulation material and the sheet of plywood. Washers are disposed on free ends of the shafts. Nuts couple with free ends of the shaft for securement of the sheet of paneling with respect to the sheet of plywood and the sheet of insulation material.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new roof panel mounting system apparatus and method which has many of the advantages of the roofing panels mentioned heretofore and many novel features that result in a new roof panel mounting system which is not anticipated, rendered obvious, suggested, or even implied by any of the prior art roofing panels, either alone or in any combination thereof.

It is another object of the present invention to provide a new roof panel mounting system which may be easily and efficiently manufactured and marketed.

It is a further object of the present invention to provide a new roof panel mounting system which is of a durable and reliable construction.

An even further object of the present invention is to provide a new roof panel mounting system which is susceptible of a low cost of manufacture with regard to both materials and labor, and which accordingly is then susceptible of low prices of sale to the consuming public, thereby making such roof panel mounting system economically available to the buying public.

Still yet another object of the present invention is to provide a new roof panel mounting system which provides in the apparatuses and methods of the prior art some of the advantages thereof, while simultaneously overcoming some of the disadvantages normally associated therewith.

Still another object of the present invention is to provide a new roof panel mounting system for securing to an underlying roof support structure to preclude leaking.

Yet another object of the present invention is to provide a new roof panel mounting system which includes a sheet of plywood secured to a support structure of a house. A sheet of insulation material is positionable on the sheet of plywood. A sheet of paneling is positionable on the sheet of insulation material. The sheet of paneling has a plurality of ridges extending upwardly therefrom. The sheet of paneling is coupled with respect to the sheet of plywood and the sheet of insulation material.

Still yet another object of the present invention is to provide a new roof panel mounting system that is not nailed or screwed into the roof.

Even still another object of the present invention is to provide a new roof panel mounting system that employs a bottom layer of plywood and a middle layer of Styrofoam insulation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
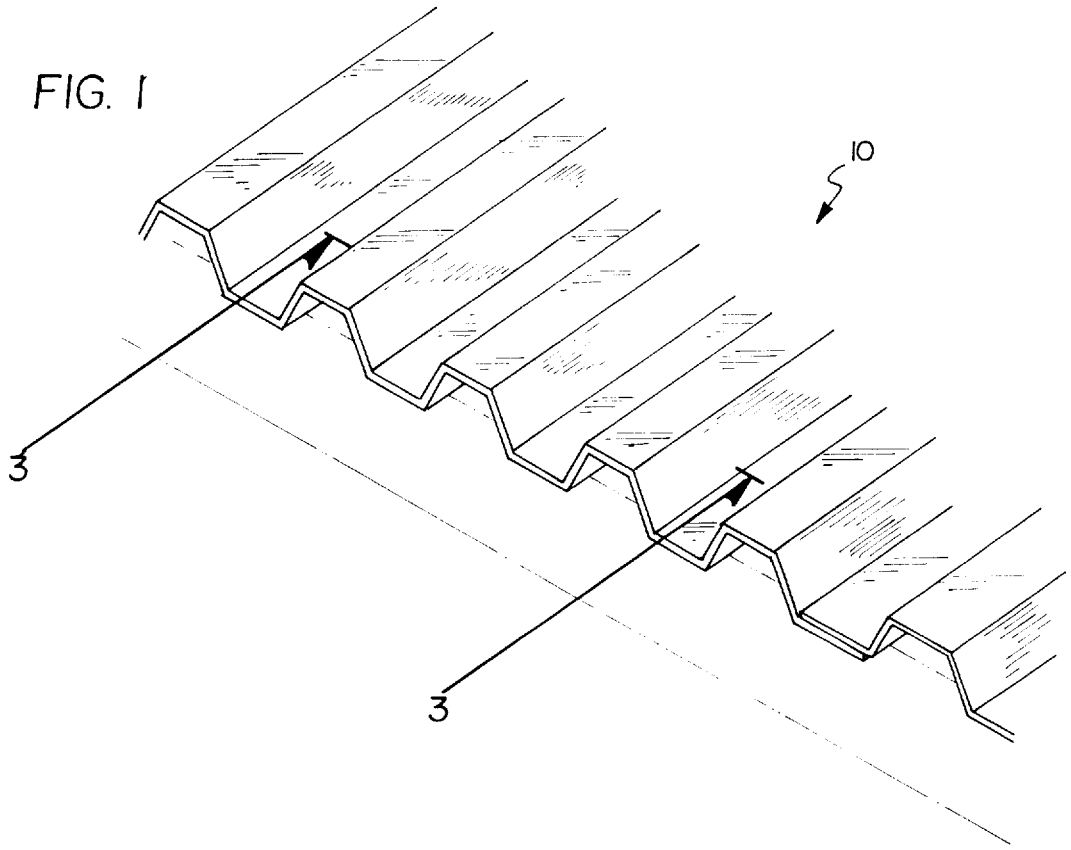
FIG. 1 is a partial perspective view of a new roof panel mounting system according to the present invention.
Figure 2:
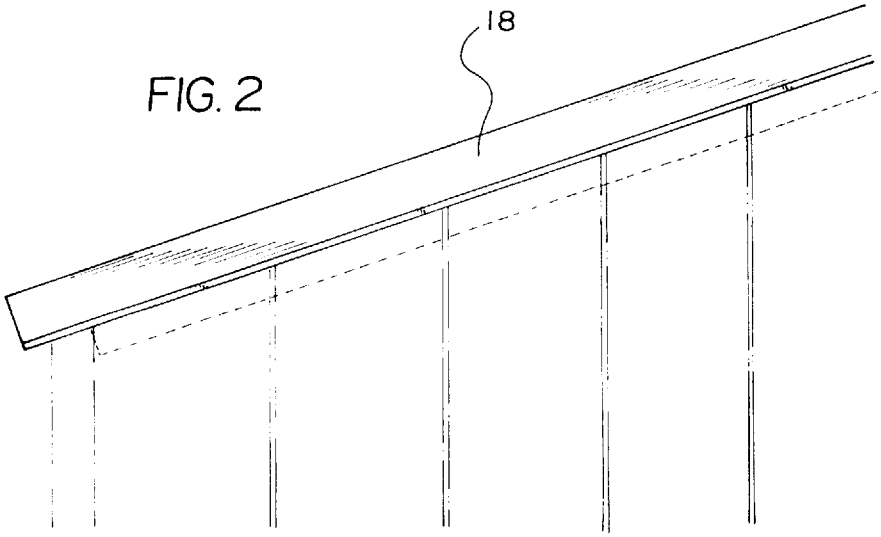
FIG. 2 is a side view of the present invention.

With reference now to the drawings, and in particular to FIGS. 1 through 9 thereof, a new roof panel mounting system embodying the principles and concepts of the present invention and generally designated by the reference numeral 10 will be described.

Figure 3:
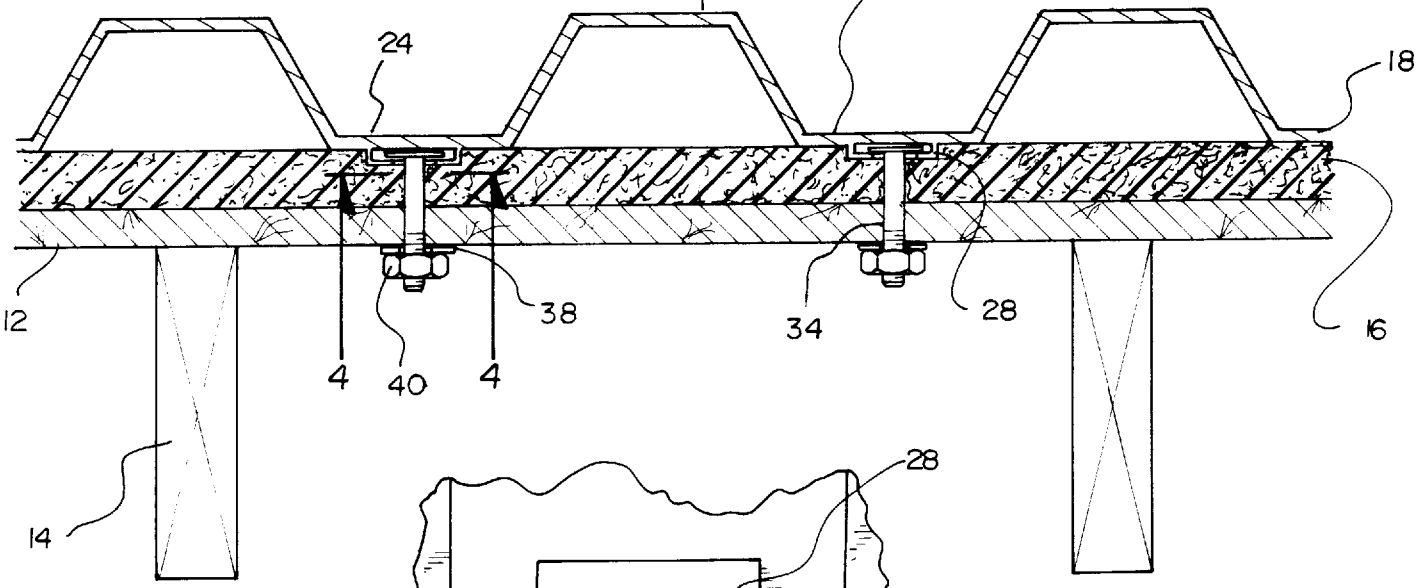
FIG. 3 is a cross-sectional view of the present invention as taken along line 3—3 of FIG. 1.
Figure 4:
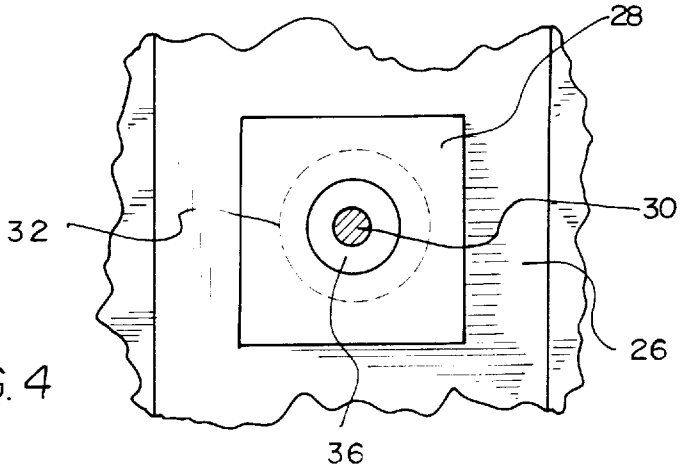
FIG. 4 is a cross-sectional view of the present invention as taken along line 4—4 of FIG. 3.

As best illustrated in FIGS. 1 through 9, the roof panel mounting system 10 comprises a sheet of plywood 12 secured to a support structure 14 of a house. The support structure 14 illustrated in FIG. 3 are support beams.

A sheet of insulation material 16 is positionable on the sheet of plywood 12. The sheet of insulation material 16 has a thickness greater than a thickness of the plywood 12. The sheet of insulation material 16 preferably incorporated into the system 10 is Styrofoam. The insulation material 16 will serve to act as a buffer for noise created by rain or the like.

A sheet of paneling 18 is positionable on the sheet of insulation material 16. The sheet of paneling 18 has a plurality of ridges 20 extending upwardly therefrom. Each of the ridges 20 has a generally trapezoidal configuration. The sheet of paneling 18 has planar portions 22 intermittently disposed between the plurality of ridges 20. Each of the planar portions 22 have an upper surface 24 and a lower surface 26. Each lower surface 26 has a chamber 28 extending downwardly therefrom.

Coupling means couple the chambers 28 of the sheet of paneling 18 with respect to the sheet of plywood 12 and the sheet of insulation material 16. The coupling means includes bolts 30 having an enlarged upper ends 32 positioned within the chambers 28. The bolts 30 have shafts 34 extending outwardly of the chambers 28 through an aperture 36 and extend through the sheet of insulation material 16 and the sheet of plywood 12. Washers 38 are disposed on free ends of the shafts 34. Nuts 40 couple with free ends of the shaft 34 for securement of the sheet of paneling 18 with respect to the sheet of plywood 12 and the sheet of insulation material 16.

Figure 5:
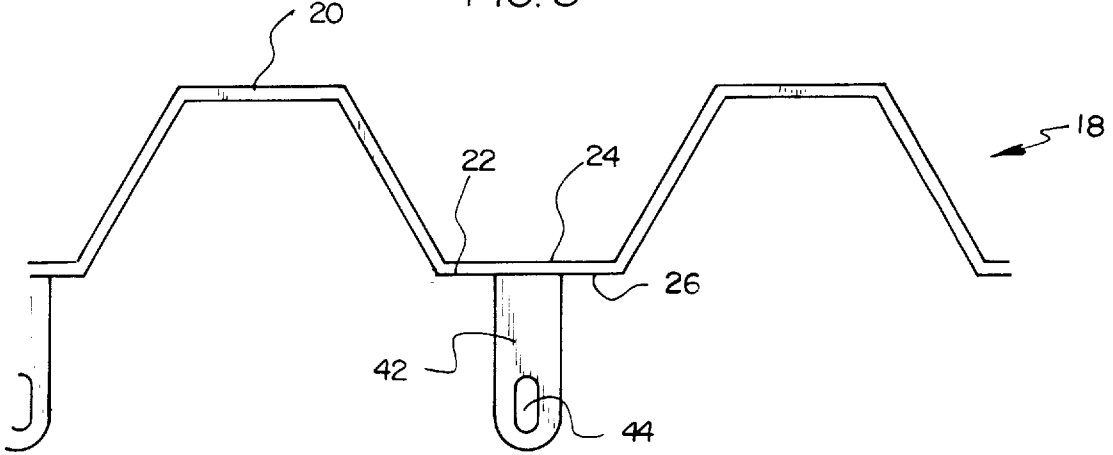
FIG. 5 is a front view of an alternate embodiment of the present invention.

Other types of coupling means are used to secure the sheet of paneling 18 with respect to the sheet of plywood 12 and the sheet of insulation material 16. FIG. 5 illustrates a tab 42 that will extend from the lower surface 26 of the planar portions 22 and through the plywood 12 and insulation material 16, after corresponding hoes are drilled through the plywood 12 and insulation material 16. The tab 42 has an aperture 44 therethrough for receiving a fastener (not illustrated) therethrough.

Figure 6:
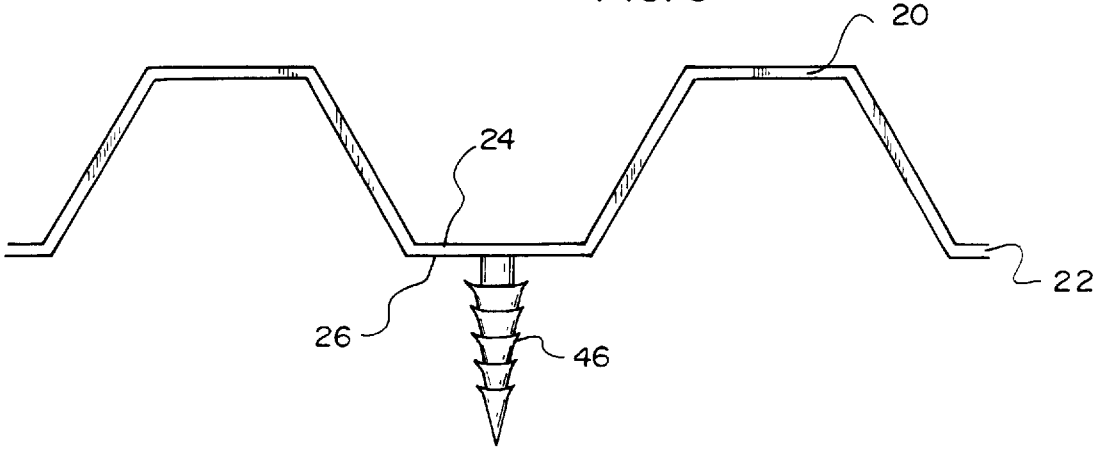
FIG. 6 is a front view of an alternate embodiment of the present invention.

FIG. 6 illustrates a flared spike 46 extending downwardly from the lower surface 26 of the planar portions 22. The flared spike 46 is positionable within a through hole drilled through the insulation material 16 and the plywood 12 whereupon a mallet or other like toll will be used to drive the flared spike into the through hole.

Figure 7:
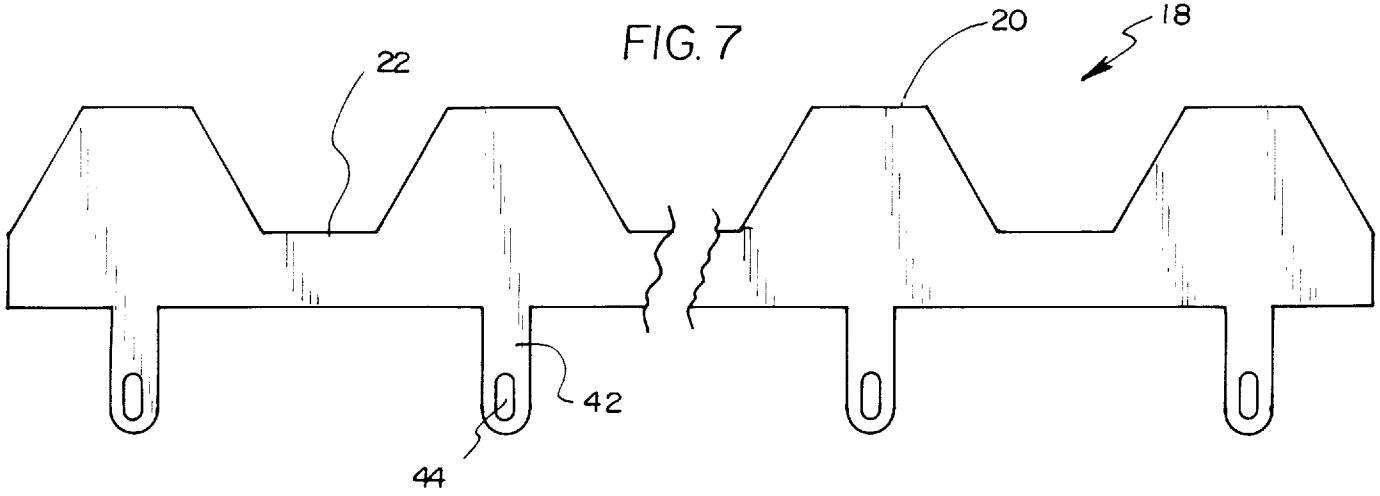
FIG. 7 is a front view of an alternate embodiment of the present invention.

FIG. 7 illustrates a sheet of paneling 18 having a supplemental support panel integrally formed therewith. This sheet of paneling 18 has tabs 42 described above.

Figure 8:
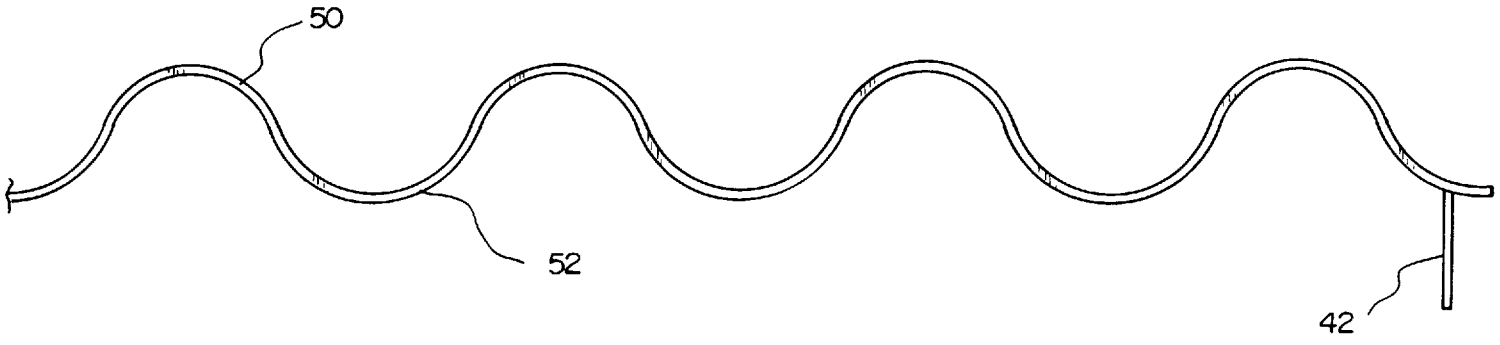
FIG. 8 is a front view of an alternate embodiment of the present invention.

FIG. 8 is a unique type of paneling having intermittent upwardly extending curves 50 and downwardly extending curves 52. An end of this panel includes a tab 42. This end tab 42 is best utilized in a roofing system at the edges using conventional hardware.

Figure 9:
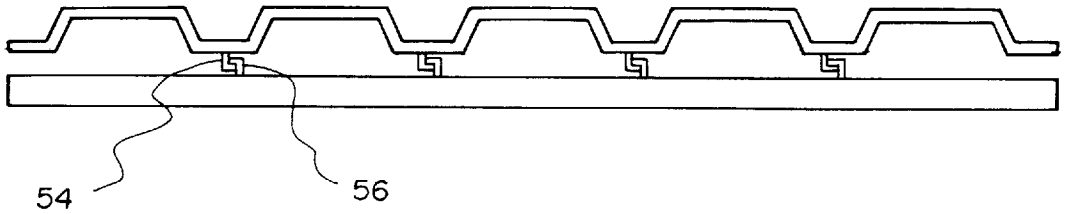
FIG. 9 is a front view of an alternate embodiment of the present invention.

FIG. 9 illustrates another coupling for the sheet of paneling 18. In this embodiment, a first running bar 54 is secured to the roof. The first running bar 56 has a horizontal lip extending a length thereof. A second running bar 54 is secured to the underside of the sheet of paneling. The second running bar 54 has a horizontal lip extending a length thereof for mating with the horizontal lip of the first running bar 56 to facilitate securement of the sheet of paneling to the roof surface.

In use, the paneling 18 with the coupling means on its lower surface is used instead of having to direct nails or screws directly through the panel. This feature will eliminate the need for any holes directed through the panels thereby limiting the chances of leaks occurring.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A roof panel mounting system comprising, in combination:

a sheet of plywood secured to a support structure of a house;

a sheet of insulation material positioned on the sheet of plywood, the sheet of insulation material having a thickness greater than a thickness of the plywood;

a sheet of paneling positioned on the sheet of insulation material, the sheet of paneling having a plurality of ridges extending upwardly therefrom, each of the ridges having a generally trapezoidal configuration, the sheet of paneling having planar portions intermittently disposed between the plurality of ridges, each of the planar portions having an upper surface and a lower surface, each lower surface having a chamber extending downwardly therefrom; and coupling means coupling the chambers of the sheet of paneling with respect to the sheet of plywood and the sheet of insulation material, the coupling means including bolts having enlarged upper ends positioned within the chambers, the bolts having shafts extending outwardly of the chambers and extending through the sheet of insulation material and the sheet of plywood, washers disposed on free ends of the shafts, nuts coupling with free ends of the shafts for securement of the sheet of paneling with respect to the sheet of plywood and the sheet of insulation material.

2. A roof panel mounting system comprising, in combination:

a sheet of plywood secured to a support structure of a house;

a sheet of insulation material positioned on the sheet of plywood;

a sheet of paneling positioned on the sheet of insulation material, the sheet of paneling having a plurality of ridges extending upwardly therefrom; and coupling means coupling the sheet of paneling with respect to the sheet of plywood and the sheet of insulation material, wherein the coupling means includes tabs extending downwardly from a lower surface of the sheet of paneling through the sheet of insulation material and the sheet of plywood, each of the tabs having an aperture therethrough for receiving a sliding fastener.

3. The roof panel mounting system as set forth in claim 2 wherein the coupling means includes bolts having enlarged upper ends positioned within chambers formed in a lower surface of the sheet of paneling, the bolts having shafts extending outwardly of the chambers and extending through the sheet of insulation material and the sheet of plywood, washers disposed on free ends of the shafts, nuts coupling with free ends of the shafts for securement of the sheet of paneling with respect to the sheet of plywood and the sheet of insulation material.

4. The roof panel mounting system as set forth in claim 2, wherein the sheet of paneling has a plurality of ridges extending upwardly therefrom, each of the ridges having a generally trapezoidal configuration, the sheet of paneling having planar portions intermittently disposed between the plurality of ridges.

5. The roof panel mounting system as set forth in claim 2 wherein the coupling means includes a flared spike extending downwardly from a lower surface of the sheet of paneling through the sheet of insulation material and the sheet of plywood.

6. The roof panel mounting system as set forth in claim 2, wherein the sheet of paneling has a continuous arcuate cross section.

7. The roof panel mounting system as set forth in claim 2 wherein the coupling means includes a first running bar secured to a roof surface, the first running bar having a horizontal lip extending a length thereof, a second running bar secured to an underside of the sheet of paneling, the second running bar having a horizontal lip extending a length thereof for mating with the horizontal lip of the first running bar to facilitate securement of the sheet of paneling to the roof surface.

8. A roof panel mounting system comprising, in combination:

a sheet of plywood secured to a support structure of a house;

a sheet of insulation material positioned on the sheet of plywood;

a sheet of paneling positioned on the sheet of insulation material, the sheet of paneling having a plurality of ridges extending upwardly therefrom; and coupling means coupling the sheet of paneling with respect to the sheet of plywood and the sheet of insulation material, wherein the coupling means includes a flared spike extending downwardly from a lower surface of the sheet of paneling through the sheet of insulation material and the sheet of plywood.

9. The roof panel mounting system as set forth in claim 8, wherein the sheet of paneling has a plurality of ridges extending upwardly therefrom, each of the ridges having a generally trapezoidal configuration, the sheet of paneling having planar portions intermittently disposed between the plurality of ridges.

10. The roof panel mounting system as set forth in claim 8, wherein the sheet of paneling has a continuous arcuate cross section.

* * * * *